US011234305B2

(12) United States Patent
Liu et al.

(10) Patent No.: US 11,234,305 B2
(45) Date of Patent: Jan. 25, 2022

(54) LIGHTING APPARATUS

(71) Applicant: XIAMEN ECO LIGHTING CO. LTD., Xiamen (CN)

(72) Inventors: Jinyong Liu, Xiamen (CN); Biao Chen, Xiamen (CN); Hongbin Lin, Xiamen (CN); Hongkui Jiang, Xiamen (CN)

(73) Assignee: XIAMEN ECO LIGHTING CO. LTD., Fujian (CN)

( * ) Notice: Subject to any disclaimer, the term of this patent is extended or adjusted under 35 U.S.C. 154(b) by 0 days.

(21) Appl. No.: 16/852,469

(22) Filed: Apr. 18, 2020

(65) Prior Publication Data

US 2021/0329762 A1 Oct. 21, 2021

(51) Int. Cl.

| | |
|---|---|
| ***H05B 45/357*** | (2020.01) |
| ***F21K 9/232*** | (2016.01) |
| ***F21K 9/238*** | (2016.01) |
| ***H05B 47/155*** | (2020.01) |
| ***H05B 45/18*** | (2020.01) |

(Continued)

(52) U.S. Cl.

CPC ..... *H05B 45/357* (2020.01); *F21K 9/232* (2016.08); *F21K 9/238* (2016.08); *H05B 45/18* (2020.01); *H05B 45/345* (2020.01); *H05B 45/37* (2020.01); *H05B 47/155* (2020.01); *H05B 47/19* (2020.01)

(58) Field of Classification Search

CPC ..... H05B 47/19; H05B 45/20; H05B 47/195; H05B 45/10; H05B 45/3725; H05B 45/375; H05B 45/38; H05B 47/11; H05B 47/16; H05B 45/325; H05B 45/395; H05B 47/125; H05B 45/385; H05B 47/115; H05B 47/18; H05B 47/105; H05B 47/185; H05B 45/357; H05B 45/12; H05B 45/37; H05B 47/24; H05B 47/28; H05B 45/3578; H05B 47/13; H05B 45/36; H05B 45/56; H05B 45/60; H05B 47/155; H05B 47/175; H05B 45/00; H05B 45/24; H05B 45/397; H05B 45/46; H05B 45/28; H05B 45/30; H05B 45/31; H05B 45/315; H05B 45/40; H05B 47/10; F21V 17/164; F21V 23/006; F21V 23/04; F21V 23/0435; F21V 29/70; F21V 29/89; F21V 3/02; F21V 5/045; F21V 7/0091; F21V 23/003; F21V 23/0492; F21V 23/06; F21V 29/74; F21V 29/83

See application file for complete search history.

(56) References Cited

U.S. PATENT DOCUMENTS 9,534,773 B1 * 1/2017 Turudic ..... F21K 9/238
9,839,103 B2 * 12/2017 Avrahamy ..... H02J 3/14

(Continued)

*Primary Examiner* — Monica C King

(74) *Attorney, Agent, or Firm* — Chun-Ming Shih; Lanway IPR Services

(57) ABSTRACT

A LED lighting apparatus includes a housing, a bulb shell, a driver plate, a light source plate, and a driver circuit. The bulb shell is connected to the housing. The bulb shell and the housing form a container space. The driver plate is set in the container space. The light source plate is set in the container space. The light source plate includes a base plate and a light emitting component on the base plate. The driver circuit includes a rectifier circuit and a constant current driver chip which are electrically connected to each other. The rectifier circuit is set on the driver plate. The constant current driver chip is set on the light source plate.

19 Claims, 8 Drawing Sheets

(51) Int. Cl.

| | |
|---|---|
| ***H05B 45/345*** | (2020.01) |
| ***H05B 47/19*** | (2020.01) |
| ***H05B 45/37*** | (2020.01) |

(56) References Cited

U.S. PATENT DOCUMENTS

| | | | | |
|---|---|---|---|---|
| 2016/0035201 | A1* | 2/2016 | Savage, Jr. | H04R 1/028 340/815.45 |
| 2017/0086281 | A1* | 3/2017 | Avrahamy | B01D 61/147 |
| 2019/0249831 | A1* | 8/2019 | Liu | F21V 29/74 |
| 2019/0320515 | A1* | 10/2019 | Sadwick | H05B 45/00 |
| 2021/0080084 | A1* | 3/2021 | Danesh | F21V 17/002 |

* cited by examiner

LIGHTING APPARATUS

FIELD

The present application is related to a lighting apparatus and more particularly related to a efficient driving circuit of a lighting apparatus.

BACKGROUND

Electroluminescence, an optical and electrical phenomenon, was discover in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

SUMMARY

In some embodiments, a lighting apparatus includes a housing, a light passing shell, a driver plate, a light source plate and a driver circuit. The light passing shell is connected to the housing, the light passing shell and the housing form a container space. The driver plate is set in the container space;

The light source plate is set in the container space, the light source plate includes a base plate and a light emitting component on the base plate. The driver circuit includes a rectifier circuit and a constant current driver chip electrically connected to each other, the rectifier circuit is set on the driver plate, the constant current driver chip is set on the light source plate, and the light emitting component is coupled with the constant current driver chip.

In some embodiments, there are multiple output terminals on the driver plate, there are multiple connecting terminals on the light source plate, and the output terminals are connected to the corresponding connecting terminals one to one to electrically connect the light emitting component and the constant current driver chip to the rectifier circuit respectively.

In some embodiments, the lighting apparatus may also include a light head connected to the bottom of the housing, wherein the light passing shell is a bulb shell.

In some embodiments, the light head includes a screw light head with electricity insulation and a conductive pin set in the middle part of the screw light head, and the screw light head and the conductive pin are electrically connected to the two input ends of the rectifier circuit respectively.

In some embodiments, the lighting apparatus may also include two power wires, wherein the bottom of the housing includes a wiring hole, one of the power wires passes through the wiring hole and is electrically connected to an input end of the rectifier circuit and the screw light head respectively, the other power wire is in the screw light head and is electrically connected to the other input end of the rectifier circuit and the conductive pin.

In some embodiments, the driver circuit includes a voltage conversion circuit, the voltage conversion circuit is connected between the output positive end of the rectifier circuit and the output negative end of the rectifier circuit, the voltage conversion circuit is set on the driver plate.

In some embodiments, the driver circuit includes a strobe filtering circuit, the strobe filtering circuit is connected in parallel to the light emitting component, the strobe filtering circuit includes at least one electrolytic capacitor, the strobe filtering circuit is set on the driver plate.

In some embodiments, the constant current driver chip includes a dimming module, a power pin, a current input pin, and a current output pin, the power pin is connected to a chip power supply circuit in the driver circuit, the current input pin is connected between a negative end of the light emitting component and the dimming module, the current output pin is grounded, the dimming module is for controlling the output current of the current output pin.

In some embodiments, the driver chip also includes a vent pin and a vent module, the vent module is connected to the dimming pin, the vent pin is connected to the vent module, the vent module is for venting current.

In some embodiments, the driver chip also includes a vent pin and a vent module, the vent module is connected to the dimming pin, the vent pin is connected to the vent module, the vent module is for venting current.

In some embodiments, the driver circuit also includes a vent protection resistor, two ends of the vent protection resistor are respectively connected to the positive end and the negative end of the light emitting component, the vent protection resistor is set on the driver plate.

In some embodiments, the light passing shell is a tubular shell, and the housing is a tubular housing for forming a light tube device.

In some embodiments, the lighting apparatus may also include a wireless circuit for receiving program codes from an external device, a driver circuit on the driver plate executes the program codes for changing how to drive the light emitting component.

In some embodiments, the program codes define dividing the light emitting components into multiple groups and controlling the multiple groups separately for achieving a visual effect corresponding to the program codes.

In some embodiments, the lighting apparatus may also include a manual switch to disable the driver circuit to execute the program codes.

In some embodiments, the driver circuit detects authenticity of the program codes, if a hacking code is detected, the driver circuit is switched as a safe mode to keep a safe operation.

In some embodiments, the driver circuit detects authenticity by recognizing a biological identical information from a detector connected to the driver circuit.

In some embodiments, the lighting apparatus may also include an antenna being disposed with a metal shield between the antenna and the driver circuit.

In some embodiments, the driver plate and the light source plate are heat connected to two thermal isolated heat sinks.

In some embodiments, the lighting apparatus may also include two separate temperature detectors on the driver plate and the light source plate to change an operation mode for the driver plate and the light source plate.

DETAILED DESCRIPTION

Figure 1:
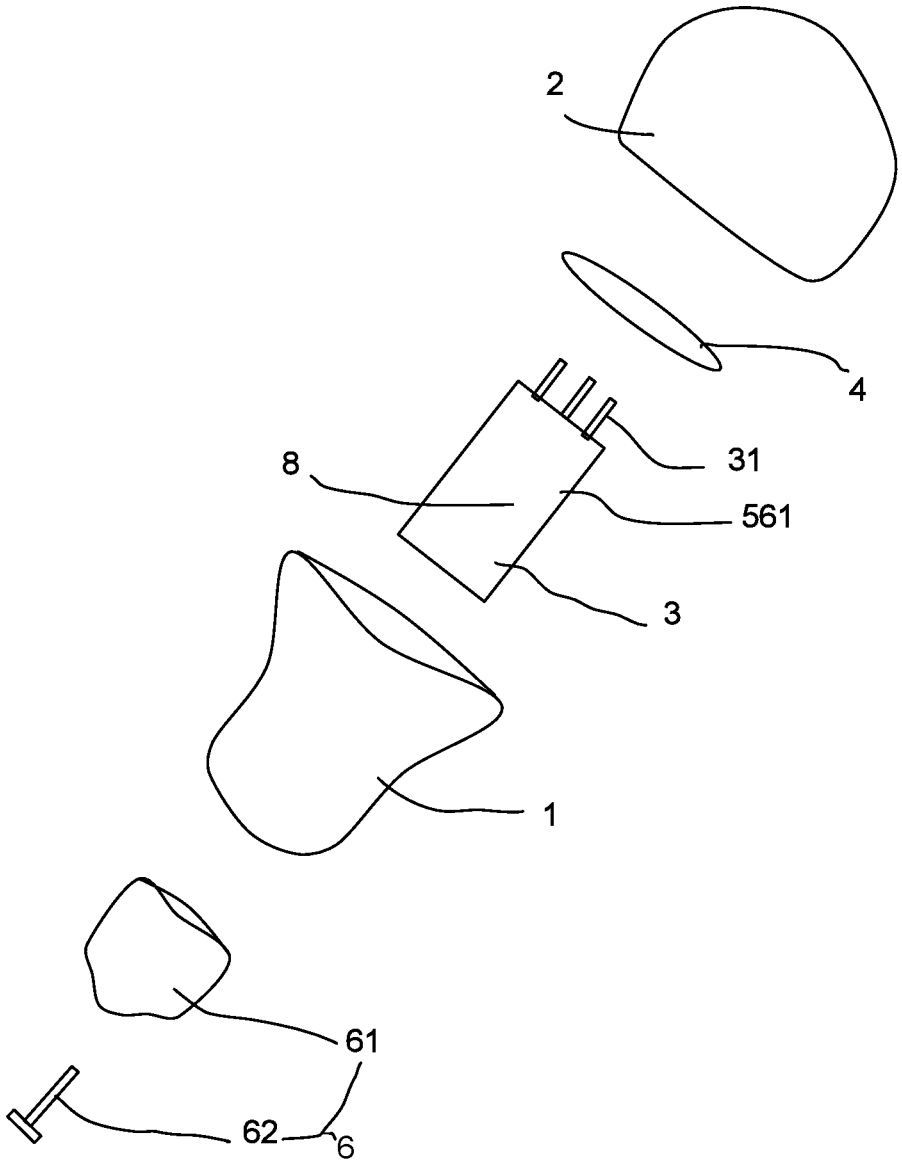
FIG. 1 is an exploded perspective view of a LED lighting apparatus.
Figure 3:
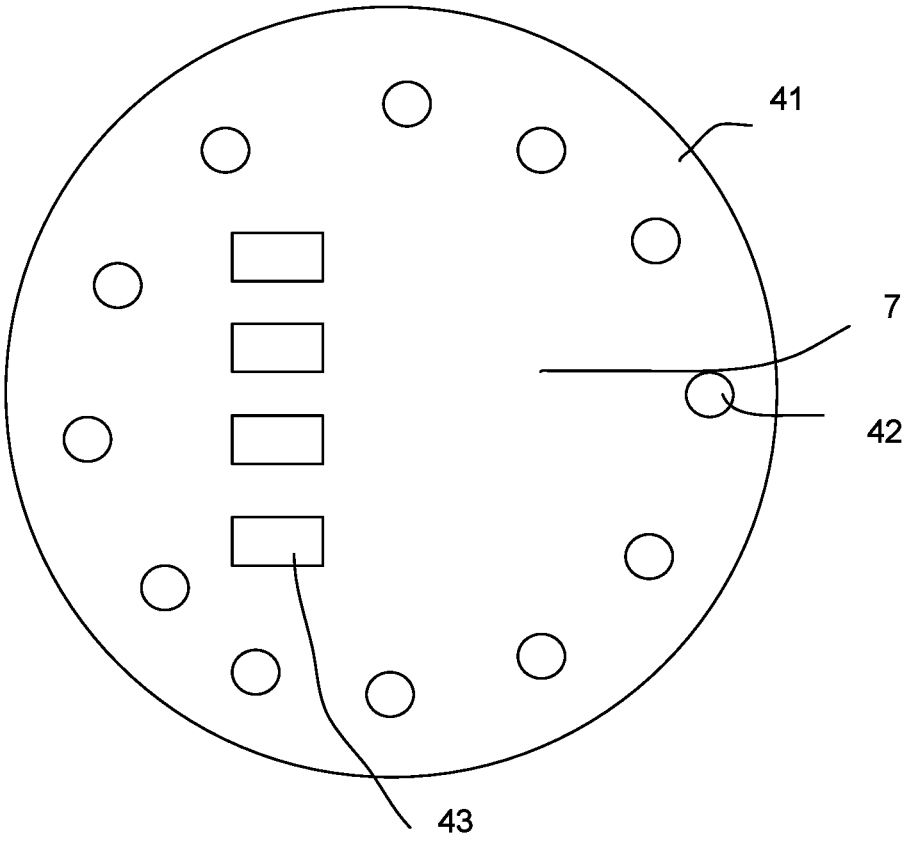
FIG. 3 is a structural view of a light source plate of the LED lighting apparatus.
Figure 4:
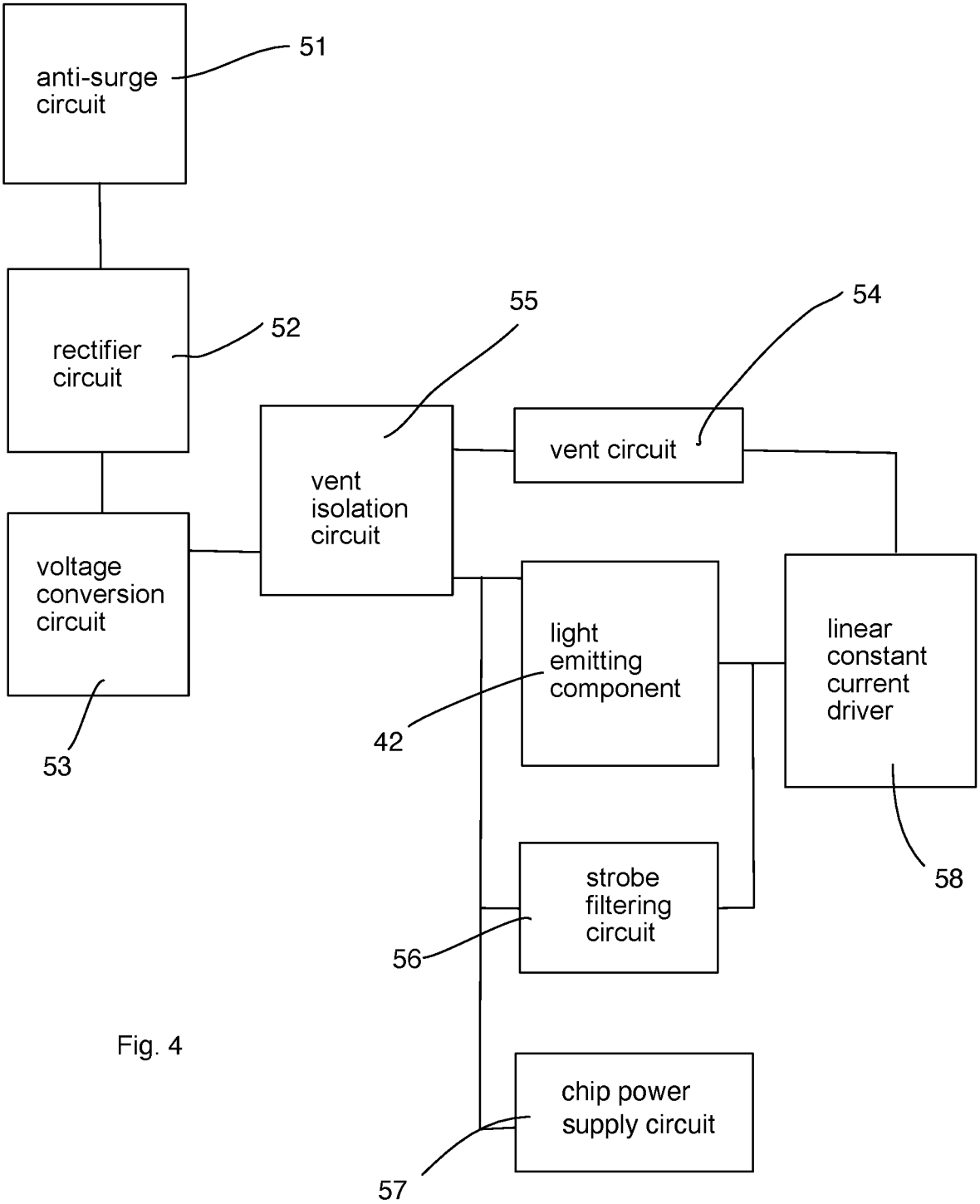
FIG. 4 is a driver relation schematic diagram of the lighting apparatus.

With reference to FIG. 1, FIG. 3, and FIG. 4, a LED lighting apparatus 100 includes a housing 1, a bulb shell 2, a driver plate 3, a light source plate 4, and a driver circuit 5.

The bub shell 2 and the housing 1 are connected and form a container space 20.

The driver plate 3, the light source plate 4, and the driver circuit 5 are set in the container space 20.

The light source plate 4 includes a base plate 41 and a light emitting component 42 on the base plate 41.

The light emitting component 42 is set and illuminate in the direction of the bulb shell 2.

The driver circuit 5 is for driving the light emitting component 42, converting the external power source into the direct current in needed voltage, and supplying the direct current to the light emitting component 42.

To be specific, the driver circuit 5 includes at least a rectifier circuit 52 and a constant current driver chip 7 which are electrically connected, and the rectifier circuit 52 is set on the driver plate 3.

The constant current driver chip 7 is set on the light source plate 4 and coupled with the light emitting component 42 to supply constant current to the light emitting component 42.

The LED light apparatus 100 includes a housing 1, a bulb shell 2, a driver plate 3, a light source plate 4, and a driver circuit 5.

The housing 1 and the bulb shell 2 are connected. The driver plate 3 is in a container space 20 formed by the bulb 2 and the housing 1.

The light source plate 4 includes a base plate 41 and a light emitting component 42 on the base plate 41.

The driver circuit 5 includes a rectifier circuit 52 and a constant current driver chip 7 which are electrically connected.

And the rectifier circuit 52 is set on the driver plate 3.

The constant current driver chip 7 is set on the light source plate 4 and coupled with the light emitting component 42.

Therefore, the constant current driver chip 7 is installed onto the light source plate 4 in the form of a patch.

The integrity of the LED lighting apparatus may be higher. At the same time, the glue wrapping in conventional process may be avoided.

The manufacturing efficiency may be higher, which is good for automated manufacturing. The material cost and the manufacturing cost may be reduced.

Specifically, the bulb shell 2 is for refraction of the light coming from the light emitting component 42 and for making the light more even and softer.

The housing 1 may be made from aluminum coated plastic.

In other words, the outer layer is plastic, and the inside is aluminum.

The material may be for containing the driver plate 3 and enhancing the heat dissipation function of the housing 1.

Then the heat on the light source plate 4 and the driver plate 3 may be exported on time to make sure that the driver circuit 5 and the light emitting component 42 work normally.

Figure 2:
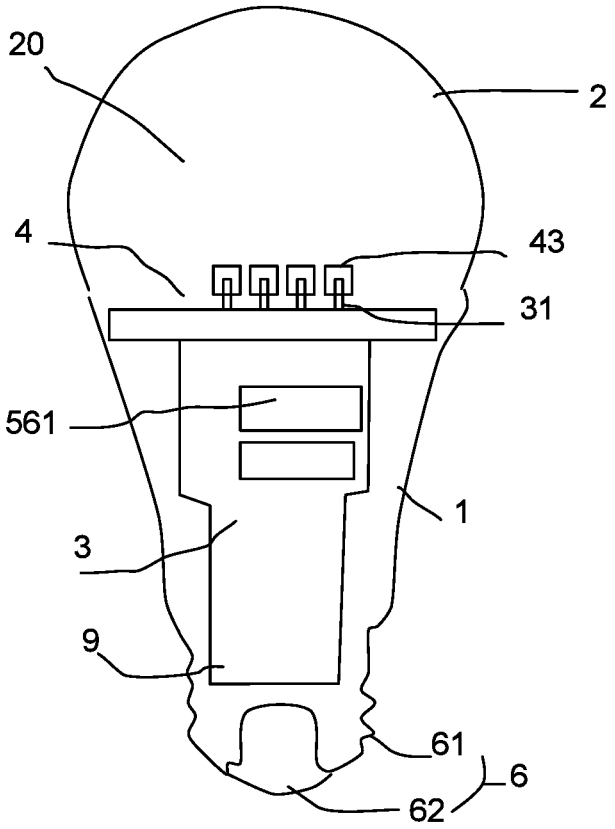
FIG. 2 is a cross-sectional view of the LED lighting apparatus.

Please refer to FIG. 1 and FIG. 2. The LED lighting apparatus 100 also includes a light head 6.

The light head 6 includes a screw light head 61 and a conductive pin 62.

The conductive 62 is set in the center of the screw light head in the form of an electricity insulation.

The screw light head 6 61 and the conductive pin 62 are connected to the two ends of the driver circuit 5 respectively and supply the external power source to the driver circuit 5 for converting and downscale voltage.

To be specific, the screw light head 61 has inner screw groove.

Around the bottom of the housing 1 has external screw groove.

With the matching of the inner screw groove and the external screw groove, the light head 6 is set around the bottom of the housing 1.

Between the screw light head 61 and the housing 1 is electricity insulation.

Referring to FIG. 1, on the driver plate 3 is two power wires 8.

One of the power wires 8 is electrically connected between the input end and the live wire of the driver circuit 5.

The other power wire 8 is connected between the output end and the neutral wire of the driver circuit 5, which forms a current circuit.

Furthermore, as illustrated in FIG. 2, the bottom of the housing 1 has a wiring hole 9.

The power wire connected between the input end and the live wire of the driver circuit 5 passes through the wiring hole 9 to be connected to the screw light head 61.

In practical application, the wiring hole 9 may be a through hole or an open form on the edge of the bottom of the housing 1 based on the actual situation.

Please refer to FIG. 3, on the light source plate 4 is multiple light emitting components 42.

The multiple light emitting component 42 may be arranged into at least one circular shape so as to be spread out more evenly on the base plate 41 to ensure the uniformity of light emission in every direction of the LED lighting apparatus 100.

The light emitting component 42 is a LED component.

The light color may be chosen based on the actual needs. The light color may be white, multicolored, or the combination of white and multicolor. There is no limitation.

Please refer to FIG. 1 and FIG. 3, on the driver plate 3 has multiple output terminals 31.

On the light source plate 4 is multiple connecting terminals 43.

The output terminals 31 are electrically connected to the corresponding connecting terminals 43 to connect the rectifier circuit 52 on the driver plate 3 with the light emitting component 42 on the base plate 41 and the constant current driver chip 7.

Figure 5:
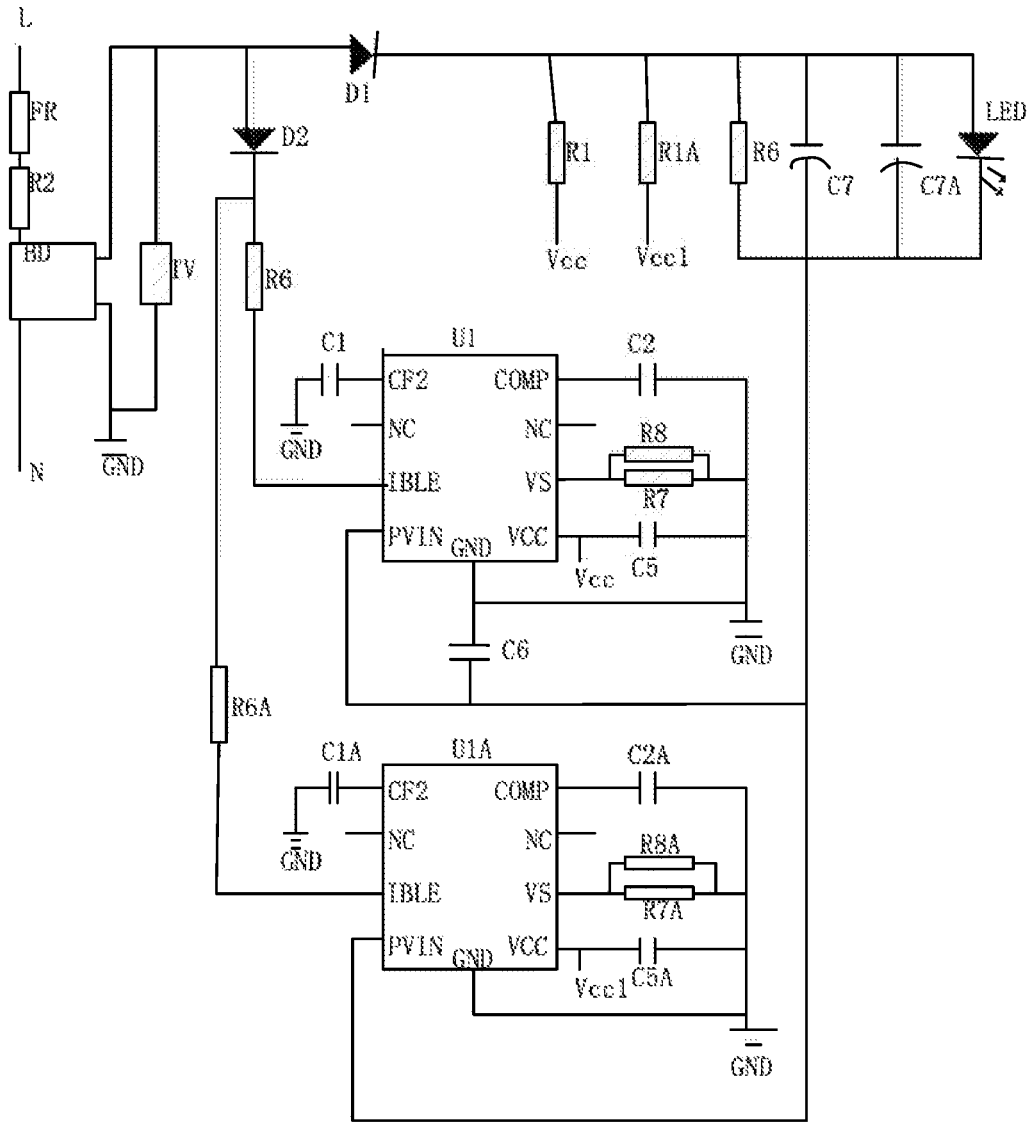
FIG. 5 is a schematic diagram of a driver circuit of the LED lighting apparatus.

Referring to FIG. 4 and FIG. 5, the rectifier circuit 52 includes a rectifier bridge BD.

The two input ends are respectively connected to a live wire L and a neutral wire.

The output positive end is connected to the positive end of the light emitting component 42.

The output negative end is grounded. (in the following description, each component is explained by the corresponding circuit symbols, and the symbols correspond to the drawings.)

In one embodiment, in the example of FIG. 4 and FIG. 5, the driver circuit 5 includes an anti-surge circuit 51, a voltage conversion circuit 53, a vent circuit 54, a vent isolation circuit 55, a strobe filtering circuit 56, and a chip power supply circuit 57.

The anti-verge circuit 51 is connected between the live wire L and the corresponding input end of the rectifier circuit 52 to suppress the voltage surge.

Specifically, the anti-surge circuit 51 includes a wire wood resistor FR.

One end of the wire wood resistor FR is connected to the live wire L. The other end is connected to the corresponding input end of the rectifier bridge BD.

The voltage conversion circuit 53 is for converting the voltage to transmit electrical energy.

To be specific, the voltage conversion circuit 53 includes a voltage transformer W.

The two ends are respectively connected to the output positive end and the output negative end of the rectifier circuit 52.

One end of the vent circuit 54 is connected to the vent isolation circuit 55.

The other end is grounded to vent the excessive voltage of the input end to ensure safety.

The vent isolation circuit 55 is connected between the output end of the voltage conversion circuit 53 and the positive end of the light emitting component 42 and between the output end of the voltage conversion circuit 53 and the vent circuit 54.

The vent isolation circuit 55 is for isolating the vented current from the light emitting component 42.

To be specific, the vent isolation circuit 55 includes at least one diode.

In the embodiment, the vent isolation circuit 55 includes a diode D1 and a diode D2.

The positive ends of the diodes D1 and D2 are connected to the output end of the voltage conversion circuit 53.

The negative end of the diode D1 is connected to the positive end of the light emitting component 42.

The negative end of the diode D2 is connected to the vent circuit 54.

The strobe filtering circuit 56 is connected in parallel with the light emitting component 42. The strobe filtering circuit 56 is for filtering the alternating wave component from the direct current.

Specifically, the strobe filtering circuit 56 includes at least on electrolytic capacitor component 561.

As shown in FIG. 5, the strobe filtering circuit 56 includes two electrolytic capacitors R7 and R7A which are connected in parallel.

One end of the electrolytic capacitor R7 and one end of the electrolytic capacitor R7A are electrically connected to the positive end of the light emitting component 42.

The other end of the electrolytic capacitor R7 and the other end of the electrolytic capacitor R7A are electrically connected to the negative end of the light emitting component 42.

The electrolytic capacitors R7 and R7A may be set on the driver plate 3.

The chip power supply circuit 57 includes divider resistors R1 and R1A.

One end of the divider resistor R1 and one end of the divider resistor R1A are connected to the positive end of the light emitting component 42.

The other end of the divider resistor R1 and the other end of the divider resistor R1A get needed chip power supply voltages Vcc and Vcc1.

There is one thing that needs to explain. There's at least one driver chip 7 based on the actual circuit and the power need.

In the embodiment, the constant current driver chips 7 are connected in parallel for diversion to avoid every constant current driver chip 7 from being burned out because of excessive current.

The two constant current driver chips are respectively U1 and U1A and have the same structure.

The way of connecting all the pins is the same.

Therefore, the chip power supply circuit 57 diverges into two ends.

The two ends are constant current driver chip U1 and U1A to supply power source.

In the embodiment, the vent circuit 54 and the constant current driver circuit 5 are integrated on the constant current driver chip 7 by choosing the suitable model of constant current driver chip U1 and U1A.

The following is the explanation in the example of the constant current driver chip U1.

Figure 6:
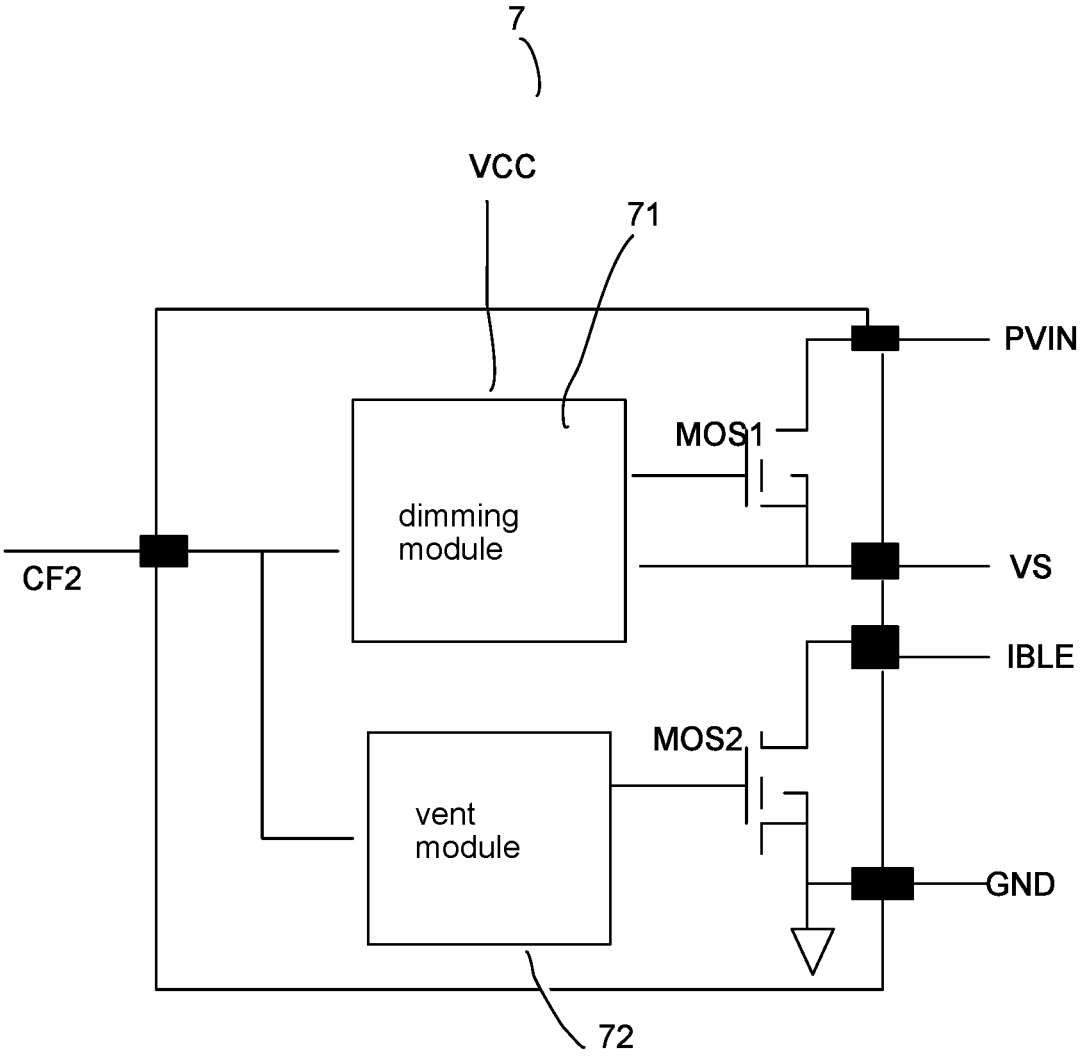
FIG. 6 is a structural frame diagram of a constant current driver chip of the LED lighting apparatus.

As illustrated in FIG. 5 and FIG. 6, the constant current driver chip U1 includes a power pin VCC, a vent pin IBLE, a current input pin PVIN, a current output pin VS, a dimming pin CF2, and a ground pin GND. Also, the constant current driver chip U1 may include a compensation pin COMP and at least one vacant space for another pin (indicated by NC in FIG. 5).

The power pin VCC is connected to the chip power supply voltage Vcc of the chip power supply circuit 57 to drive the constant current driver chip to work.

The vent pin IBLE passes through the resistance R6 to be connected to the negative end of the diode D2 to sense strength of the current passing through the diode D2.

The current input pin PVIN is connected to the negative end of the light emitting component 42.

The current output pin VS is grounded.

The dimming pin CF2 is for connecting the dimmer. The ground pin GND is for grounding.

In the example of FIG. 6, a dimming module 71, a vent module 72, and field effect transistor MOS1 and MOS2 are integrated in the constant current driver chip U1.

The dimming module 71 is connected to the gate of the field effect transistor MOS.

The current input pin PVIN is connected to the drain electrode of the field effect transistor MOS1.

The current output pin VS is connected to the source electrode of the field effect transistor MOS1.

The vent module 72 is connected to the gate of the field effect transistor MOS2.

The vent pin IBLE is connected to the drain electrode of the field effect transistor MOS2.

The source electrode of the field effect transistor MOS2 is grounded.

Under a certain gate source electrode voltage, the output current of the current output pin VS is related to the gate source electrode voltage of the field effect transistor MOS1, and the current output from the current output pin VS may be guaranteed to be stable by making sure that the gate source electrode voltage is stable.

And then the constant current of the light emitting component 42 may be accomplished.

At the same time, the current output pin VS is connected to the dimming module 71 to give the feedback about the strength of the current to the dimming module 71.

The dimming module 71 runs comparison and adjustment based on the feedback about the strength of the current to further stabilize and adjust the output current of the current output pin VS.

For example, in one situation, the field effect transistor MOS1 may work in the MOSFET.

When the dimming pin CF2 is connected to the dimmer (the dimmer is not grounded like in FIG. 5), by inputting the dimming signal, the dimming pin CF2 changes the gate source electrode voltage of the field effect transistor MOS1 to change the current of the current output pin VS to adjust the light.

When the source electrode and the drain electrode of the field effect transistor MOS1 have reverse leakage current because of changing the gate source electrode voltage of the field effect transistor MOS1, the dimming signal of the dimming pin CF2 may be input into the vent module 72 at the same time.

Then the gate source electrode of the field effect transistor MOS2 may be changed. The constant current driver U1 and the whole circuit may be guaranteed to work in the best condition by the field effect transistor MOS2 and the vent pin IBLE compensating and absorbing the leakage current.

As shown in FIG. 5, the two ends of the light emitting component 42 are connected in parallel with the vent protection resistor R6.

The vent protection resistor R6 is for venting the electrical charge of the electrolytic capacitors R7 and R7A to protect the light emitting component 42 when the circuit is off.

The vent protection resistor R6 is preferably set on the driver plate 3, which may simplify the design of the light source plate 4.

Referring to FIG. 1, FIG. 2, and FIG. 5, in the embodiment, there are four connecting terminals 43 and four output terminals 31.

Each connecting terminal 43 corresponds to one output terminal 31. One connecting terminal 43 and one output terminal 31 form an electrical terminal.

The electrical terminal is for connecting a part of the driver circuit 5 on the driver plate 3 to a part of the driver circuit 5 on the light source plate 4.

To be specific, one electrical terminal is connected to the positive end of the light emitting component 42.

Another electrical terminal is set between the divider resistor R6 and R6A and the diode D2.

The divider resistor R6 and R6A may be set on the light source plate 4.

Another electrical terminal is connected between the output end of the chip power supply circuit 57 and the input end VCC of the driver chips U1 and U1A.

And the last electrical terminal is for grounding the current output ends VS of the two driver chips U1 and U1A, the ground end GND, and other pins that need to be grounded through the driver plate 3.

LED (Light-Emitting Diode) has the advantages of low working voltage and high optical efficiency.

LED is considered to be a new light source of lighting in 21st century.

Now, a driver circuit of a LED light bulb is integrated on a driver module.

In order to meet the heat dissipation need, during assembly, the driver module needs glue wrapping, and the glue wrapping leads to higher overall cost and complicated production.

The LED lighting apparatus is for solving the technical problems that the conventional LED lighting apparatus has higher overall cost and complicated operation.

A LED lighting apparatus includes a housing, a bulb shell, a driver plate, a light source plate, and a driver circuit.

The bulb shell is connected to the housing. The bulb shell and the housing form a container space.

The driver plate is set in the container space.

The light source plate is set in the container space. The light source plate includes a base plate and a light emitting component on the base plate.

And the driver circuit includes a rectifier circuit and a constant current driver chip which are electrically connected to each other.

And the rectifier circuit is set on the driver plate.

The constant current driver chip is set on the light source plate.

The light emitting component is coupled with the constant current driver chip.

In one embodiment, on the driver plate includes multiple output terminals.

On the light source plate includes multiple connecting terminals.

The output terminals are connected to the corresponding connecting terminals one to one to electrically connect the light emitting component and the constant current driver chip to the rectifier circuit respectively.

In one embodiment, the LED lighting apparatus includes a light head connected to the bottom of the housing.

The light head includes a screw light head with electricity insulation and a conductive pin set in the middle part of the screw light head.

The screw light head and the conductive pin are electrically connected to the two input ends of the rectifier circuit respectively.

In one embodiment, the LED lighting apparatus includes two power wires.

The bottom of the housing includes a wiring hole.

One of the power wires passes through the wiring hole and is electrically connected to an input end of the rectifier circuit and the screw light head respectively.

The other power wire is in the screw light head and is electrically connected to the other input end of the rectifier circuit and the conductive pin.

In one embodiment, the driver circuit includes a voltage conversion circuit.

The voltage conversion circuit is connected between the output positive end of the rectifier circuit and the output negative end of the rectifier circuit.

The voltage conversion circuit is set on the driver plate.

In one embodiment, the driver circuit includes a strobe filtering circuit.

The strobe filtering circuit is connected in parallel to the light emitting component.

The strobe filtering circuit includes at least one electrolytic capacitor.

The strobe filtering circuit is set on the driver plate.

In one embodiment, the constant current driver chip includes a dimming module, a power pin, a current input pin, and a current output pin.

The power pin is connected to a chip power supply circuit in the driver circuit.

The current input pin is connected between a negative end of the light emitting component and the dimming module.

The current output pin is grounded.

The dimming module is for controlling the output current of the current output pin.

In one embodiment, the LED lighting apparatus includes a dimmer.

The driver chip also includes a dimming pin.

The dimming pin is connected between the dimmer and the dimming module. And the dimming pin is for inputting the dimming signal of the dimmer to the dimming module.

The dimming module controls the output current of the current output pin based on the dimmer signal.

In one embodiment, the driver chip also includes a vent pin and a vent module.

The vent module is connected to the dimming pin.

The vent pin is connected to the vent module.

The vent module is for venting current.

In one embodiment, the driver circuit also includes a vent protection resistor.

Two ends of the vent protection resistor are respectively connected to the positive end and the negative end of the light emitting component.

The vent protection resistor is set on the driver plate.

The LED lighting apparatus includes a housing, a bulb shell, a driver plate, a light source plate, and a driver circuit.

The bulb shell is connected to the housing.

The driver plate is in the container space formed by the bulb shell and the housing.

The light source plate includes a base plate and a light emitting component on the base plate.

The driver circuit includes a rectifier circuit and a constant current driver chip which are electrically connected.

Then, the rectifier circuit is set on the driver plate.

The constant current driver chip is set on the light source plate and is coupled with the light emitting component.

The constant current driver chip is set on the light source plate in the form of a patch.

The integrity of the LED lighting apparatus may be higher. At the same time, the glue wrapping in conventional process may be avoided.

The manufacturing efficiency may be higher, which is good for automated manufacturing. The material cost and the manufacturing cost may also be reduced.

In order to explain the technical proposal more clearly, the following is the brief introduction of the needed drawings.

The following drawings are just some embodiments. For those skilled in the art, other drawings may be obtained according to these drawings without any creative work.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

Figure 7:
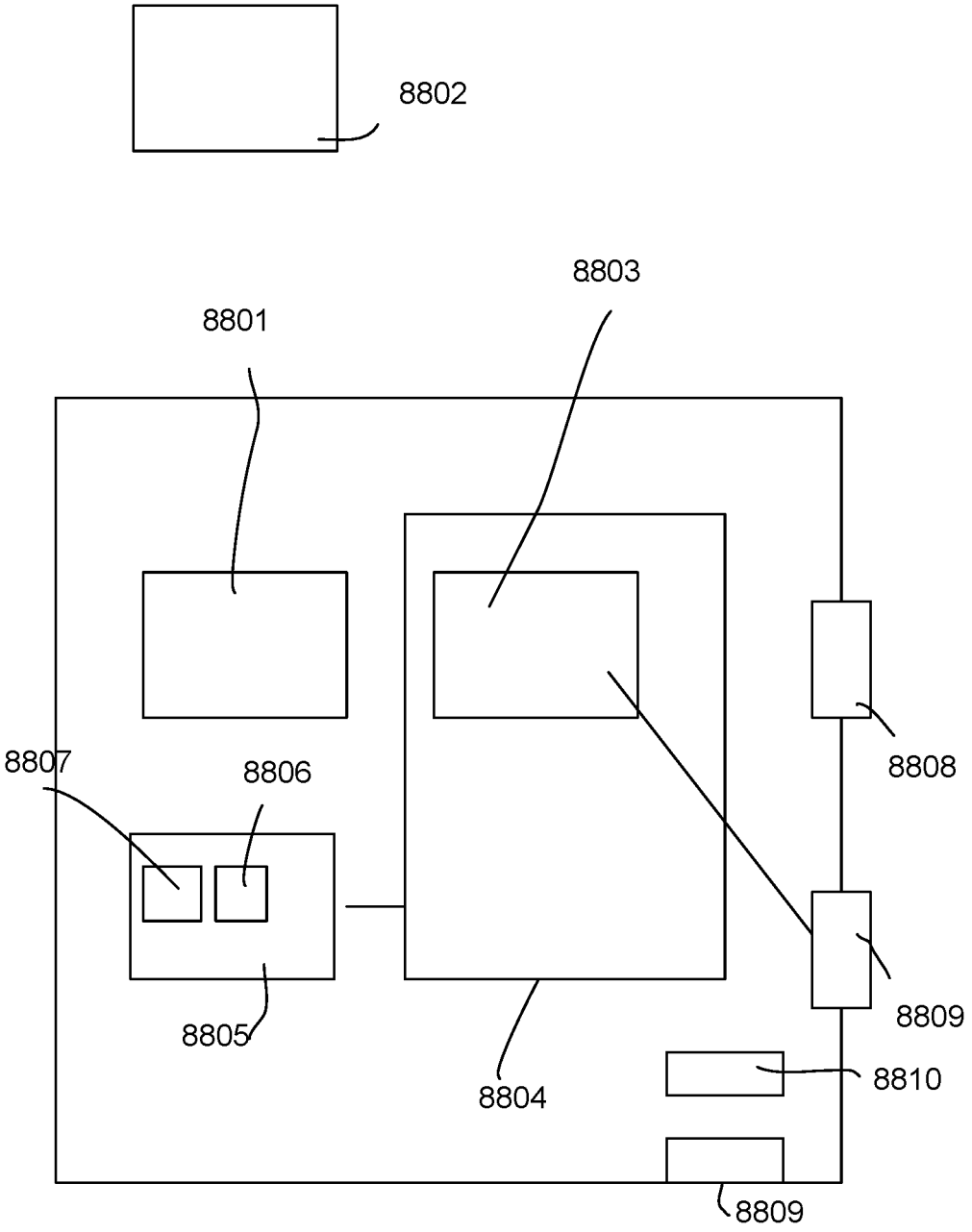
FIG. 7 shows another embodiment with wireless functions.

In FIG. 7, the lighting apparatus may also include a wireless circuit 8801 for receiving program codes from an external device 8802*tt*, a driver circuit 8803 on the driver plate 8804 executes the program codes for changing how to drive the light emitting component 8805.

In FIG. 7, the program codes define dividing the light emitting components 8805 into multiple groups 8806, 8807 and controlling the multiple groups 8806, 8807 separately for achieving a visual effect, mixing different color temperatures corresponding to the program codes.

In FIG. 7, the lighting apparatus may also include a manual switch 8808 to disable the driver circuit to execute the program codes.

In some embodiments, the driver circuit detects authenticity of the program codes, if a hacking code is detected, the driver circuit is switched as a safe mode to keep a safe operation.

In FIG. 7, the driver circuit detects authenticity by recognizing a biological identical information from a detector 8809 connected to the driver circuit 8803.

In FIG. 7, the lighting apparatus may also include an antenna 8809 being disposed with a metal shield 8810 between the antenna 8809 and the driver circuit 8803.

Figure 8:
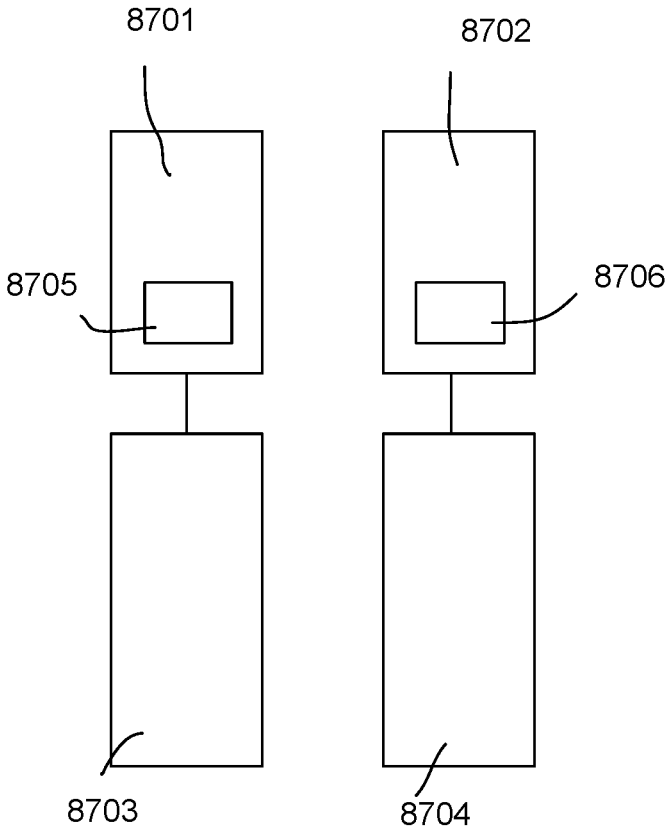
FIG. 8 shows another embodiment.

In FIG. 8, the driver plate 8701 and the light source plate 8702 are heat connected to two thermal isolated heat sinks 8703, 8704.

In some embodiments, the lighting apparatus may also include two separate temperature detectors 8705, 8706 on the driver plate 8701 and the light source plate 8702 to change an operation mode for the driver plate and the light source plate.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a housing;

a light passing shell, wherein the light passing shell is connected to the housing, the light passing shell and the housing form a container space;

a driver plate, wherein the driver plate is set in the container space;

a light source plate, wherein the light source plate is set in the container space, the light source plate includes a base plate and a light emitting component on the base plate; and a driver circuit, wherein the driver circuit includes a rectifier circuit and a constant current driver chip electrically connected to each other, the rectifier circuit is set on the driver plate, the constant current driver chip is set on the light source plate, the light emitting component is coupled with the constant current driver chip, wherein the constant current driver chip includes a dimming module, a power pin, a current input pin, and a current output pin, the power pin is connected to a chip power supply circuit in the driver circuit, the current input pin is connected between a negative end of the light emitting component and the dimming module, the current output pin is grounded, the dimming module is for controlling the output current of the current output pin.

2. The lighting apparatus of claim 1, wherein there are multiple output terminals on the driver plate, there are multiple connecting terminals on the light source plate, and the output terminals are connected to the corresponding connecting terminals one to one to electrically connect the light emitting component and the constant current driver chip to the rectifier circuit respectively.

3. The lighting apparatus of claim 1, further comprising a light head connected to the bottom of the housing, wherein the light passing shell is a bulb shell.

4. The lighting apparatus of claim 3, wherein the light head includes a screw light head with electricity insulation and a conductive pin set in the middle part of the screw light head, and the screw light head and the conductive pin are electrically connected to the two input ends of the rectifier circuit respectively.

5. The lighting apparatus of claim 1, further comprising two power wires, wherein the bottom of the housing includes a wiring hole, one of the power wires passes through the wiring hole and is electrically connected to an input end of the rectifier circuit and the screw light head respectively, the other power wire is in the screw light head and is electrically connected to the other input end of the rectifier circuit and the conductive pin.

6. The lighting apparatus of claim 1, wherein the driver circuit includes a voltage conversion circuit, the voltage conversion circuit is connected between the output positive end of the rectifier circuit and the output negative end of the rectifier circuit, the voltage conversion circuit is set on the driver plate.

7. The lighting apparatus of claim 1, wherein the driver circuit includes a strobe filtering circuit, the strobe filtering circuit is connected in parallel to the light emitting component, the strobe filtering circuit includes at least one electrolytic capacitor, the strobe filtering circuit is set on the driver plate.

8. The lighting apparatus of claim 1, wherein the driver chip also includes a vent pin and a vent module, the vent module is connected to the dimming pin, the vent pin is connected to the vent module, the vent module is for venting current.

9. The lighting apparatus of claim 1, wherein the driver chip also includes a vent pin and a vent module, the vent module is connected to the dimming pin, the vent pin is connected to the vent module, the vent module is for venting current.

10. The lighting apparatus of claim 1, wherein the driver circuit also includes a vent protection resistor, two ends of the vent protection resistor are respectively connected to the positive end and the negative end of the light emitting component, the vent protection resistor is set on the driver plate.

11. The lighting apparatus of claim 1, wherein the light passing shell is a tubular shell, and the housing is a tubular housing for forming a light tube device.

12. The lighting apparatus of claim 1, further comprising a wireless circuit for receiving program codes from an external device, a driver circuit on the driver plate executes the program codes for changing how to drive the light emitting component.

13. The lighting apparatus of claim 12, wherein the program codes define dividing the light emitting components into multiple groups and controlling the multiple groups separately for achieving a visual effect corresponding to the program codes.

14. The lighting apparatus of claim 12, further comprising a manual switch to disable the driver circuit to execute the program codes.

15. The lighting apparatus of claim 12, wherein the driver circuit detects authenticity of the program codes, if a hacking code is detected, the driver circuit is switched as a safe mode to keep a safe operation.

16. The lighting apparatus of claim 15, wherein the driver circuit detects authenticity by recognizing a biological identical information from a detector connected to the driver circuit.

17. The lighting apparatus of claim 12, further comprising an antenna being disposed with a metal shield between the antenna and the driver circuit.

18. The lighting apparatus of claim 1, wherein the driver plate and the light source plate are heat connected to two thermal isolated heat sinks.

19. The lighting apparatus of claim 18, further comprising two separate temperature detectors on the driver plate and the light source plate to change an operation mode for the driver plate and the light source plate.

* * * * *